US010162309B2

(12) United States Patent
Saglini

(10) Patent No.: US 10,162,309 B2
(45) Date of Patent: Dec. 25, 2018

(54) MECHANICAL TIMEPIECE MOVEMENT WITH POWER RESERVE DETECTION

(71) Applicant: ETA SA Manufacture Horlogere Suisse, Grenchen (CH)

(72) Inventor: Julien Saglini, Biel-Bienne (CH)

(73) Assignee: ETA SA Manufacture Horlogere Suisse, Grenchen (CH)

( * ) Notice: Subject to any disclaimer, the term of this patent is extended or adjusted under 35 U.S.C. 154(b) by 0 days.

(21) Appl. No.: 15/724,833

(22) Filed: Oct. 4, 2017

(65) Prior Publication Data

US 2018/0095422 A1 Apr. 5, 2018

(30) Foreign Application Priority Data

Oct. 4, 2016 (EP) ..... 16192232

(51) Int. Cl.

| | |
|---|---|
| ***G04B 9/00*** | (2006.01) |
| ***G04B 11/02*** | (2006.01) |
| ***G04B 1/16*** | (2006.01) |
| ***G04B 1/22*** | (2006.01) |

(52) U.S. Cl.

CPC ..... *G04B 11/022* (2013.01); *G04B 1/16* (2013.01); *G04B 1/22* (2013.01); *G04B 9/00* (2013.01); *G04B 9/005* (2013.01)

(58) Field of Classification Search

CPC ... G04B 1/16; G04B 1/22; G04B 9/00; G04B 9/005; G04B 11/022

See application file for complete search history.

(56) References Cited

U.S. PATENT DOCUMENTS

2012/0243385 A1 9/2012 Goeller

FOREIGN PATENT DOCUMENTS

| | | |
|---|---|---|
| CH | 710 320 A2 | 5/2016 |
| EP | 1 760 548 A1 | 3/2007 |
| EP | 2 503 405 A1 | 9/2012 |

OTHER PUBLICATIONS

European Search Report dated Mar. 30, 2017 in European Application 16192232.3, filed on Oct. 4, 2016 (with English Translation of Categories of cited documents).

*Primary Examiner* — Vit W Miska

(74) *Attorney, Agent, or Firm* — Oblon, McClelland, Maier & Neustadt, L.L.P.

(57) ABSTRACT

The mechanical timepiece movement with power reserve indication comprises at least one barrel system connected to a winding wheel of a differential gear and an unwinding wheel of the differential gear. An intermediate wheel of the differential gear is connected to a cam wheel set to drive it in rotation via a reducing stage. A rack, which acts on a power reserve indicator, is in contact with the cam wheel set. When the power reserve is at zero, a locking part of the rack comes into contact with a locking member to lock the movement at an unwinding output of the barrel system or in contact with the unwinding wheel of the differential gear.

11 Claims, 2 Drawing Sheets

MECHANICAL TIMEPIECE MOVEMENT WITH POWER RESERVE DETECTION

This application claims priority from European Patent Application No. 16192232.3 filed on Oct. 4, 2016, the entire disclosure of which is hereby incorporated herein by reference.

FIELD OF THE INVENTION

The present invention concerns a mechanical timepiece movement provided with power reserve detection means.

BACKGROUND OF THE INVENTION

A mechanical timepiece movement generally includes a barrel system driving at least one wheel at the winding output and one wheel at the unwinding output respectively connected to a winding wheel and to an unwinding wheel of a differential gear. A set of wheels connected to an intermediate wheel of the differential gear controls a power reserve display, but no element of the movement is provided to stop the movement when the power reserve is at zero.

EP Patent 0 568 499 B1 describes a power reserve indicator device for a mechanical watch. The indicator device includes at least one star-wheel with an indicator member, which is driven in rotation during the winding or unwinding of the barrel. The indicator member makes it possible to display the power reserve of the watch. However, nothing is provided to ensure that the movement is stopped when the power reserve approaches zero.

CH Patent 698 752 B1 describes a timepiece which includes a power reserve indicator mechanism. It includes two barrels facing each other and connected by a common arbor, which controls the power reserve display mechanism. However, nothing is provided to ensure that the movement is stopped when the power reserve approaches zero.

CH Patent Application 710 320 A2 describes a timepiece, which includes a mechanical energy source, such as a barrel and a control member connected to a control device inside the watch case. The control device includes a power reserve wheel mounted to pivot on the frame and connected to the barrel by a differential gear so that the angular position of the power reserve wheel is dependent on the degree of wind of the barrel. A control cam is mounted to pivot on the same axis as the power reserve wheel. The control cam has a hole extending in an arc of a circle inside which is housed a pin integral with the power reserve wheel. A spiral spring is mounted between the power reserve wheel and the cam. Connected to the control device, there is also provided a stop device, which includes a stop lever, for stopping the movement when the power reserve is close to zero.

SUMMARY OF THE INVENTION

It is therefore a main object of the invention to overcome the drawbacks of the prior art by proposing a mechanical timepiece movement provided with power reserve detection means and capable of stopping operation of the movement when the power reserve is close to zero.

To this end, the present invention concerns a mechanical timepiece movement provided with power reserve detection means, which includes the features of the independent claim 1.

Particular embodiments of the mechanical timepiece movement are defined in the dependent claims 2 to 11.

One advantage of the mechanical timepiece movement lies in the fact that it is possible, with the same element movable via the cam wheel set, to control the power reserve indication and to achieve locking via the locking member of the movement, when the power reserve is at zero. Even with the power reserve indication at zero, the barrel of the barrel system is still sufficiently wound to operate the timepiece movement. However, advantageously, the mechanical timepiece movement is locked for security when the power reserve indication is at zero.

BRIEF DESCRIPTION OF THE DRAWINGS

The objects, advantages and features of a mechanical timepiece movement provided with power reserve detection means will appear more clearly in the following description, in a non-limiting manner, with reference to the drawings, in which.

DETAILED DESCRIPTION OF THE INVENTION

In the following description, all those components of a mechanical timepiece movement provided with power or running reserve detection means that are well known to those skilled in the art in this technical field will be described only in a simplified manner.

Figure 1A:
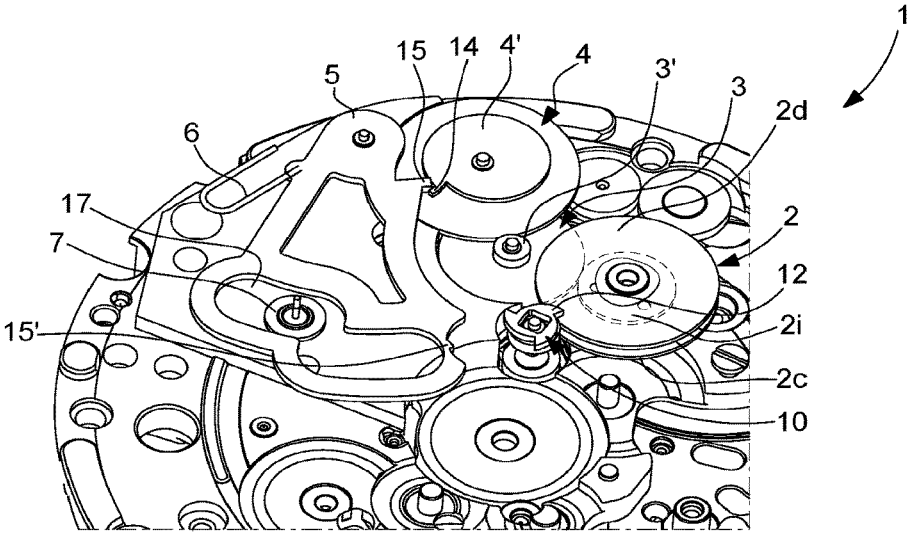
FIGS. 1*a* and 1*b* represent a three-dimensional top view of an embodiment of a mechanical timepiece movement provided with power reserve detection means according to the invention.
Figure 1B:
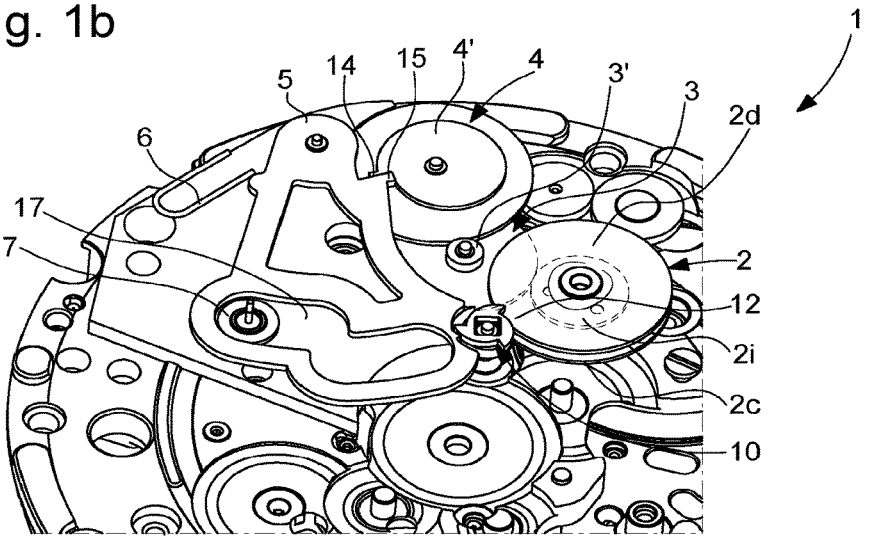

FIGS. 1*a* and 1*b* represent a three-dimensional top view of the components of mechanical timepiece movement 1 in a normal operating position in FIG. 1*a* and in a position locking the movement in FIG. 1*b*. Mechanical timepiece movement 1 includes at least one barrel system (not represented), which is disposed, for example, on one face of a watch plate of the movement or of another support plate. This barrel system may be a well known system with a single barrel or two barrels or more than two barrels, and having a winding output and an unwinding output for driving a time base gear train.

Mechanical timepiece movement 1 includes, for example, a differential gear 2 which is mounted to rotate about a rotational axis and respectively connected to the winding output and to the unwinding output of the barrel system. Differential gear 2 is connected directly or via a rotational speed reducing or increasing stage to the winding output and to the unwinding output of the barrel system. Preferably, differential gear 2 is connected via a rotational speed reducing stage to the winding output and to the unwinding output of the barrel system in order to reduce the rotation for detection of the power reserve explained below.

Differential gear 2 includes a first winding wheel 2*c* and a second unwinding wheel 2*d* preferably disposed on the same axis of rotation as the first winding wheel. Differential gear 2 further includes an intermediate wheel 2*i* between winding wheel 2*c* and unwinding wheel 2*d* and in contact with the winding wheel and the unwinding wheel particularly via a ball or roller bearing arrangement.

In normal operation of the timepiece movement after an operation to wind the barrel system, winding wheel 2*c* remains immobile without rotating, whereas unwinding wheel 2*d* is rotating. In this manner, intermediate wheel 2*i* is driven in rotation in the same direction as unwinding wheel 2*d,* but at a lower rotational speed than the rotational speed of unwinding wheel 2*d.*

Intermediate wheel 2*i* of differential gear 2 is connected to a cam wheel set 4, for example, via a rotational speed reducing stage 3. This reducing stage may be a drive wheel 3, whose toothed outer periphery can mesh with an outer toothing of intermediate wheel 2*i,* whereas a central pinion 3' of smaller diameter comes into contact with cam wheel set 4. This cam wheel set 4 may also be a wheel 4, on which there is fixedly arranged, on the axis of rotation, a disc or at least an angular sector 4' acting as a cam to drive a movable element 5 in order to actuate a power reserve indicator. The disc or the angular sector may be integral or made with the wheel of wheel set 4 in contact with central pinion 3' of drive wheel 3. The wheel of wheel set 4 and central pinion 3' may be provided with a toothing for meshing with one another.

Figure 2:
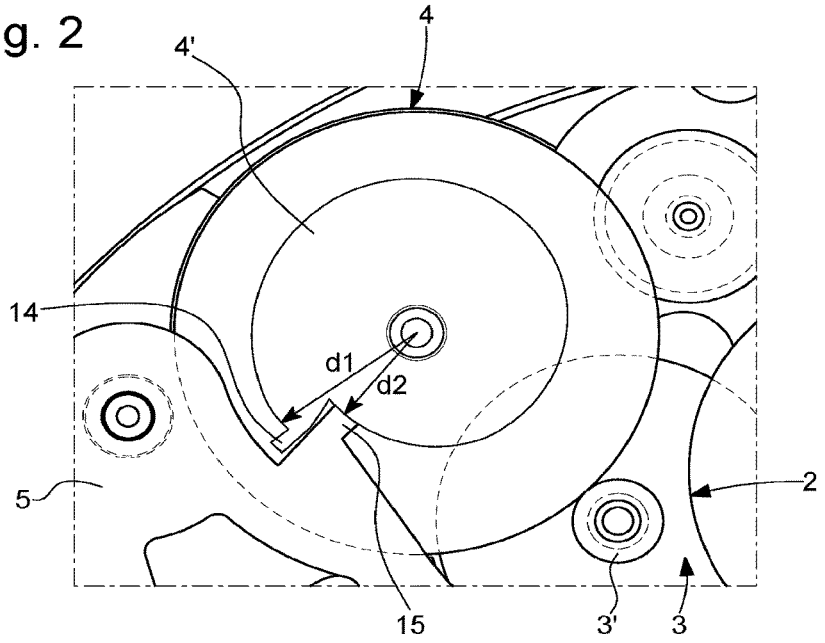
FIG. 2 represents a top view of the cam wheel set of the mechanical timepiece movement according to the invention.
Figure 3:
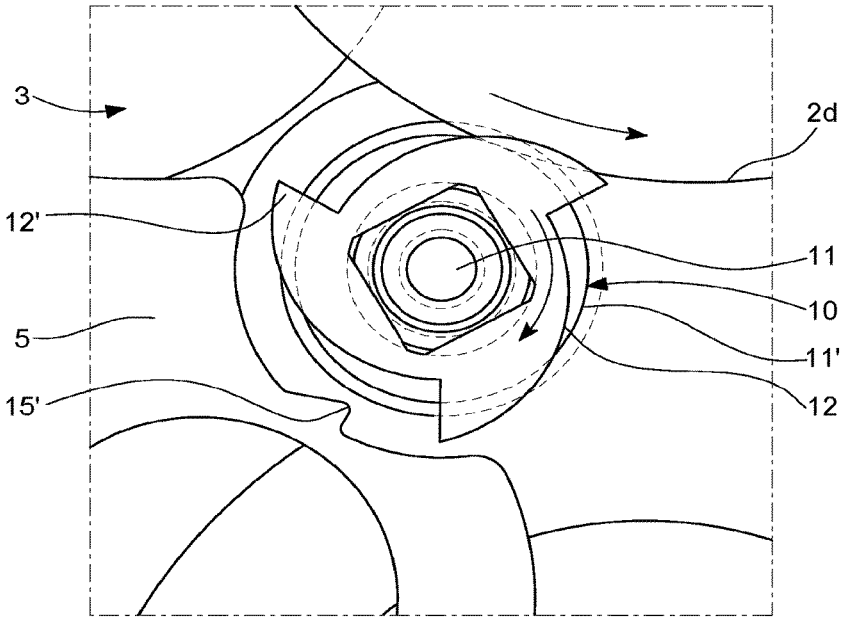
FIG. 3 represents the locking member in contact with the movable element to lock the mechanical timepiece movement when the power reserve is at zero according to the invention.

As represented in FIG. 2, the periphery of the disc or of angular sector 4' defines a curve with a distance to the axis of rotation that is variable from a first end of the disc or of angular sector 4' to a second end of the disc or of the angular sector. The radius or the distance to the axis of rotation from the periphery of the disc or of the angular sector is variable from the first end to the second end. Preferably, the distance to the axis of rotation may decrease over at least one part of the disc or of the angular sector between the first end and the second end and in a regular manner. The distance d1 to the axis of rotation from the first end of the disc or of the angular sector is greater than the distance d2 to the axis of rotation from the second end of the disc or of angular sector 4' to control locking of the movement.

Movable element 5 includes a corner 15 arranged to enter into contact with the periphery of the disc or of angular sector 4' by being pushed against the periphery by a spring 6 as shown in FIGS. 1*a* and 1*b*. This spring 6 pushes movable element 5 against a lateral surface towards the periphery of the disc or of angular sector 4'. This movable element 5 may be mounted to rotate about an axis of rotation. As represented in FIGS. 1*a* and 1*b,* movable element 5 may be in the form of a flat-shaped rack, but any other shape may be envisaged for this movable element.

When the barrel or barrels of the barrel system are fully wound, corner 15 of rack 5 comes into contact with a stop 14 of the first end of the disc or of angular sector 4', where the radius or distance to the centre of rotation is greatest. A power reserve indicator 7 is thus provided to display a fully wound indication. This power reserve indicator includes a display wheel 7 possibly with a hand (not represented) fixed on the axis of rotation of display wheel 7. Display wheel 7 is, for example, driven in rotation in contact with an inner surface of an oblong aperture in rack 5 at a distance from its axis of rotation. Display wheel 8 may be toothed to mesh with an inner toothing of oblong aperture 17 in rack 5.

When the power reserve approaches zero, the radius or the distance from corner 15 of rack 5 in contact at the centre of rotation is smallest at the second end of the disc or of the angular sector. In this case, rack 5 includes a locking part 15' that comes into contact with a locking member 10. This locking member 10 is directly connected to the unwinding output of the barrel system or to unwinding wheel 2*d* of differential gear 2 to lock the watch movement, when the power reserve (RDM) is at zero.

This locking member 10 is an intermediate wheel set between the unwinding output wheel of the barrel system and unwinding wheel 2*d* of the differential gear and may also act as a reducing stage. It is also possible to envisage locking member 10 being connected to other wheels of a reducing stage from the unwinding output of the barrel system to unwinding wheel 2*d* of differential gear 2. Locking member 10 takes the form of an arbor 11 with or without a toothed portion, which is mounted for rotation. This wheel-shaped portion 11' on arbor 11 may come into contact with an output wheel of the barrel system or preferably with unwinding wheel 2*d* of differential gear 2. At least one tooth 12' on the rotatably mounted locking member 10 is arranged to be hooked by a catch 15' of the locking part of rack 5, when the power reserve is at zero.

In FIGS. 1*a* and 1*b* and 4, locking member 10 thus includes a star-shaped wheel 12, for example with three teeth 12', which is fixed on arbor 11 above wheel-shaped portion 11' mounted on arbor 11 in contact with unwinding wheel 2*d* of differential gear 2. However, the number of locking teeth provided is not important provided that one of the teeth comes into contact with catch 15' of the locking part of rack 5.

From the description that has just been given, several variant embodiments of the mechanical timepiece movement with power reserve detection means may be devised by those skilled in the art without departing from the scope of the invention defined by the claims. The movable element for actuating the power reserve indicator and coming into contact with the locking member when the power reserve is at zero could be moved in a rectilinear manner and not in a rotary manner by the cam wheel set. The timepiece movement may take the form of a module with all the elements disposed inside said module.

What is claimed is:

1. A mechanical timepiece movement with power reserve indication, comprising at least one barrel system connected to a winding wheel of a differential gear and an unwinding wheel of the differential gear, an intermediate wheel of the differential gear being connected to at least one cam wheel set for the driving thereof in rotation, a movable element in contact with the cam wheel set acting on an indicator of the power reserve to be displayed, wherein the movable element is arranged to move and actuate a locking member to lock the movement at an unwinding output of the barrel system or in contact with the unwinding wheel of the differential gear, when the power reserve indicator indicates zero, and in that the cam wheel set includes a wheel for connection to the intermediate wheel of the differential gear and a cam above the wheel for contact with a corner of the movable element.

2. The mechanical timepiece movement according to claim 1, wherein the cam wheel set is driven in rotation via a rotational speed reducing stage disposed between the intermediate wheel and a wheel of the cam wheel set.

3. The mechanical timepiece movement according to claim 2, wherein the reducing stage includes a drive wheel in contact with the intermediate wheel of the differential gear, and in that a central pinion of the drive wheel is in contact with the wheel of the cam wheel set.

4. The mechanical timepiece movement according to claim 1, wherein the cam of the cam wheel set is a disc or an angular sector, disposed on the axis of rotation of the wheel of the cam wheel set, the distance from the axis of rotation to the periphery of the disc or of the angular sector in contact with the corner of the movable element decreasing between a first end and a second end of the disc or of the angular sector so as to move the movable element between a position of complete winding and a position locking the movement.

5. The mechanical timepiece movement according to claim 4, wherein the cam includes a stop at the first end, where the distance to the axis of rotation is greatest and against which the corner of the movable element presses in the completely wound position of the barrel system.

6. The mechanical timepiece movement according to claim 4, wherein the periphery of the disc-shaped cam defines a curve with a distance to the axis of rotation that is variable from the first end of the disc to the second end of the disc.

7. The mechanical timepiece movement according to claim 4, wherein the movable element is a rack mounted for rotation about an axis of rotation.

8. The mechanical timepiece movement according to claim 7, wherein the rack is pushed against the cam wheel set via a spring.

9. The mechanical timepiece movement according to claim 7, wherein the rack includes an aperture of oblong shape inside which is placed a wheel of the power reserve indicator, the indicator wheel being in contact with an inner surface of the aperture so as to be driven in rotation by the motion of the rack pushed by the cam wheel set.

10. The mechanical timepiece movement according to claim 7, wherein the rack is of flat shape with a catch on a locking part that comes into contact with the locking member in a locking position, when the corner of the rack is at the second end of the disc or of the angular sector of the cam.

11. The mechanical timepiece movement according to claim 1, wherein the locking member includes an arbor mounted for rotation and with a wheel-shaped portion in contact with an unwinding output wheel of the barrel system or with the unwinding wheel of the differential gear, and in that the locking member includes a star wheel with at least one locking tooth fixed on the arbor to be hooked in the movement locking position by a catch of the movable element, when the power reserve is at zero.

* * * * *